US010024554B2

(12) United States Patent
Hayashi et al.

(10) Patent No.: US 10,024,554 B2
(45) Date of Patent: Jul. 17, 2018

(54) INDOOR UNIT OF AIR-CONDITIONING APPARATUS

(71) Applicant: Mitsubishi Electric Corporation, Tokyo (JP)

(72) Inventors: Tomoki Hayashi, Tokyo (JP); Yukihiko Kawanori, Tokyo (JP); Keiichi Yamamoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/500,584

(22) PCT Filed: Nov. 14, 2014

(86) PCT No.: PCT/JP2014/080227
§ 371 (c)(1),
(2) Date: Jan. 31, 2017

(87) PCT Pub. No.: WO2016/075817
PCT Pub. Date: May 19, 2016

(65) Prior Publication Data

US 2017/0219222 A1 Aug. 3, 2017

(51) Int. Cl.
*F24F 1/00* (2011.01)
*F24F 13/20* (2006.01)

(52) U.S. Cl.
CPC ..... *F24F 1/0022* (2013.01); *F24F 1/00* (2013.01); *F24F 13/20* (2013.01); *F24F 1/0007* (2013.01); *F24F 1/0059* (2013.01); *F24F 2001/004* (2013.01)

(58) Field of Classification Search
CPC .. F24F 1/0022; F24F 13/20; F24F 1/00; F24F 1/0007; F24F 1/0059; F24F 2001/004
See application file for complete search history.

(56) References Cited

U.S. PATENT DOCUMENTS 3,524,328 A * 8/1970 Schuster ..... F24F 1/02 165/122
2011/0237177 A1* 9/2011 Stewart ..... F24F 3/0442 454/338

FOREIGN PATENT DOCUMENTS

JP S59-113142 U 7/1984
JP H01-120009 U 8/1989
JP 06-032919 U 4/1994
JP 10-160189 A 6/1998
(Continued)

OTHER PUBLICATIONS

International Search Report of the International Searching Authority dated Feb. 17, 2015 for the corresponding International application No. PCT/JP2014/080227 (and English translation).

*Primary Examiner* — Emmanuel Duke
(74) *Attorney, Agent, or Firm* — Posz Law Group, PLC

(57) ABSTRACT

An indoor unit of an air-conditioning apparatus includes an air-sending device unit having an air-sending device unit housing configured to house an air-sending device and provided with an air inlet; and a heat exchanger unit having a heat exchanger unit housing configured to house an indoor heat exchanger, provided with an air outlet, and configured to be coupled to the air-sending device unit housing, wherein the air-sending device includes a rotating fan, an electric motor, and a casing, the casing, the air inflow port, and the air-sending device unit housing, a first rail unit, and a slide member.

14 Claims, 15 Drawing Sheets

(56) References Cited

FOREIGN PATENT DOCUMENTS

| | | | |
|---|---|---|---|
| JP | 2001-349574 | A | 12/2001 |
| JP | 2004-245481 | A | 9/2004 |
| JP | 2009-041836 | A | 2/2009 |
| JP | 2013-007543 | A | 1/2013 |

* cited by examiner

INDOOR UNIT OF AIR-CONDITIONING APPARATUS

CROSS REFERENCE TO RELATED APPLICATION

This application is a U.S. national stage application of PCT/JP2014/080227 filed on Nov. 14, 2014, the contents of which are incorporated herein by reference.

TECHNICAL FIELD

The present invention relates to an indoor unit of an air-conditioning apparatus, and more particularly, to an attachment/detachment structure of an air-sending device mounted on the indoor unit of the air-conditioning apparatus.

BACKGROUND ART

Among indoor units of an air-conditioning apparatus, an indoor unit containing an air-sending device unit equipped with a sirocco fan and a heat exchanger unit equipped with an indoor heat exchanger has been proposed (see, for example, Patent Literature 1).

With the indoor unit of an air-conditioning apparatus described in Patent Literature 1, which is equipped with a sirocco fan, a direction of air blowing out of an air outlet of the indoor unit is not perpendicular to a formation surface of the air outlet, but inclined with respect to the formation surface of the air outlet. In this manner, by changing an attitude of the indoor unit in up, down, left, and right directions, the indoor unit equipped with a sirocco fan, can change an airflow direction to upward, rightward, leftward, and downward directions.

CITATION LIST

Patent Literature

Patent Literature 1: Japanese Unexamined Patent Application Publication No. 2009-41836

SUMMARY OF INVENTION

Technical Problem

In the indoor unit of an air-conditioning apparatus described in Patent Literature 1, an air-sending device provided on the air-sending device unit is fixed to a housing of the air-sending device unit, for example, with screws. Consequently, to change the direction of the air blowing out of the indoor unit, it is necessary to change the attitude of the air-sending device unit including the entire housing. Here, the indoor unit of an air-conditioning apparatus described in Patent Literature 1 is fixed, for example, by being concealed in a ceiling. Therefore, a serviceman needs to perform a task of unfixing the air-sending device unit and heat exchanger unit fixed in the ceiling and changing the attitudes of the air-sending device unit and heat exchanger unit.

Means of changing the direction of the air blowing out of the indoor unit includes means of changing the attitude of the air-sending device alone by releasing screw fastening of the air-sending device in the air-sending device unit. However, the air-sending device itself has considerable weight, and there is a problem in that changing the attitude of the air-sending device increases a work load on the serviceman.

The present invention has been made to solve the above problems and has an object to provide an indoor unit of an air-conditioning apparatus, the indoor unit curbs increase in a workload of changing a direction of the air-sending device in changing an airflow direction.

Solution to Problem

An indoor unit of an air-conditioning apparatus according to one embodiment of the present invention comprises: an air-sending device unit having an air-sending device unit housing configured to house an air-sending device and provided with an air inlet; and a heat exchanger unit having a heat exchanger unit housing configured to house an indoor heat exchanger, provided with an air outlet, and configured to be coupled to the air-sending device unit housing, wherein the air-sending device includes: a rotating fan, an electric motor configured to drive the fan, and a casing provided with an air inflow port and an air outflow port and equipped with the fan and the electric motor, the air inflow port being configured to take in air and the air outflow port being configured to blow out air, and the air-sending device unit housing includes: an opening port formed at a position of coupling to the heat exchanger unit housing and communicated with the heat exchanger unit housing, a first rail unit provided on each of a second side face orthogonal to a first side face in which the opening port is formed and a third side face opposed to the second side face, and a slide member fixed to the air outflow port of the casing of the air-sending device and configured to be movable on the first rail units.

Advantageous Effects of Invention

Being configured as described above, the indoor unit of an air-conditioning apparatus according to one embodiment of the present invention curbs increase in a workload of changing a direction of the air-sending device in changing an airflow direction.

DESCRIPTION OF EMBODIMENTS

An embodiment of an indoor unit of an air-conditioning apparatus according to the present invention will be described below with reference to the drawings. Note that the present invention is not limited by the embodiment described below. Also, in the following drawings including FIG. 1, components may not be shown in their real size relations.

Embodiment

Figure 1:
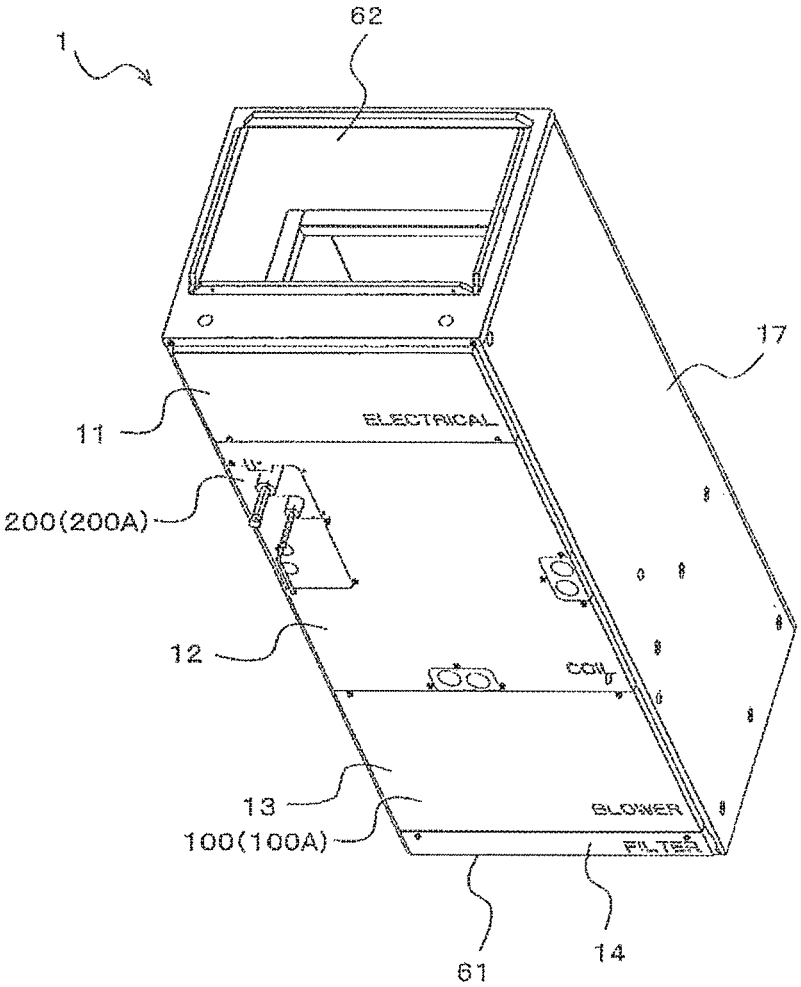
FIG. 1 is a perspective view of an indoor unit 1 of an air-conditioning apparatus according to an embodiment of the present invention.
Figure 2:
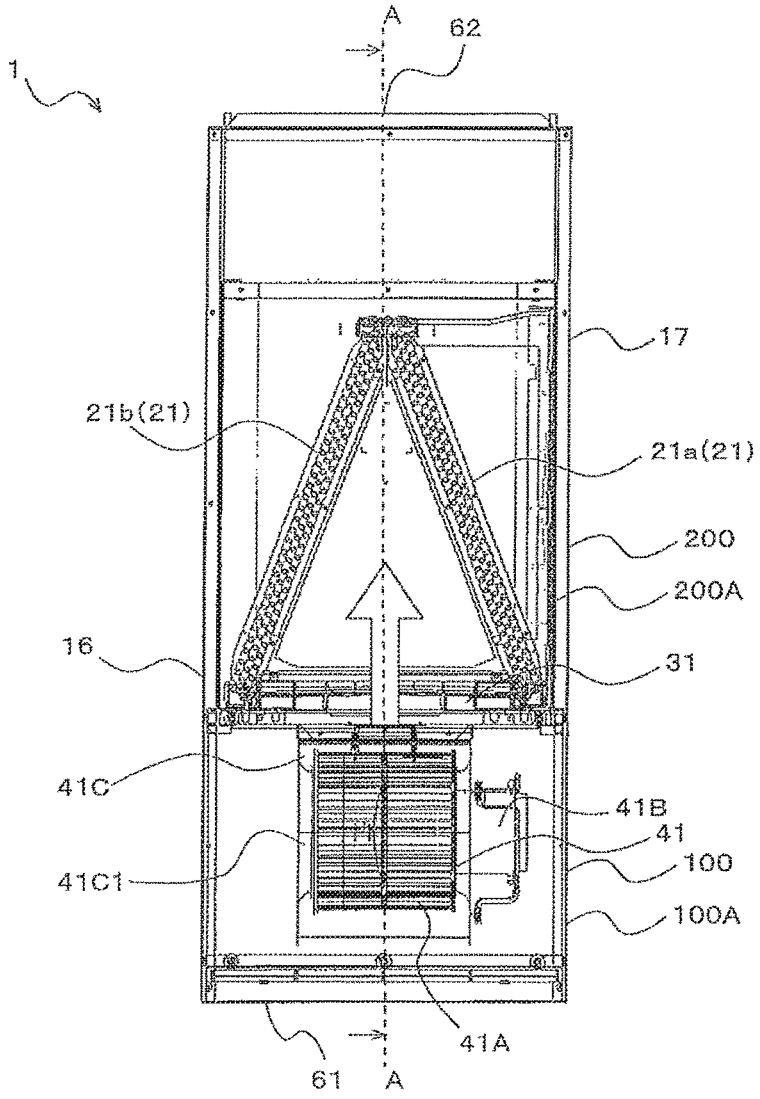
FIG. 2 is a longitudinal sectional view of the indoor unit 1 shown in FIG. 1 when installed in such a manner as to blow out upward.
Figure 3:
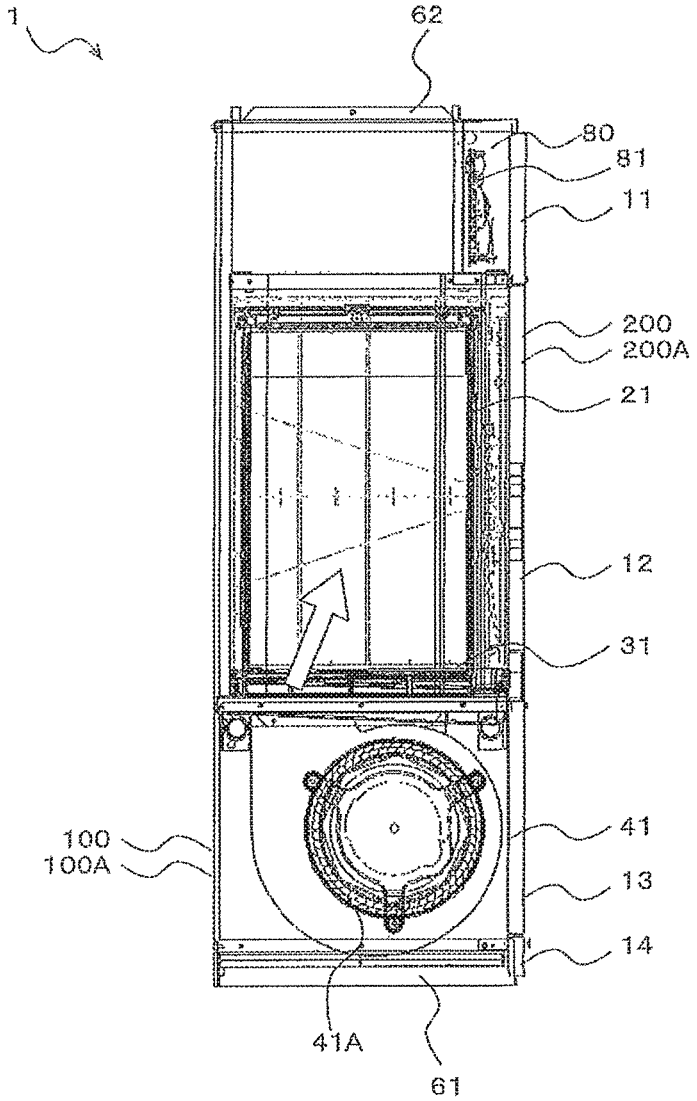
FIG. 3 is a sectional view of the indoor unit 1 shown in FIG. 2 taken along line A-A.

FIG. 1 is a perspective view of an indoor unit 1 of an air-conditioning apparatus according to the present embodiment. FIG. 2 is a longitudinal sectional view of the indoor unit 1 shown in FIG. 1 when installed in such a manner as to blow out upward. FIG. 3 is a sectional view of the indoor unit 1 shown in FIG. 2 taken along line A-A. A configuration and the like of the indoor unit 1 will be described with reference to FIGS. 1 to 3.

[Description of Configuration]

The indoor unit 1 includes an air-sending device unit 100 and a heat exchanger unit 200, where the air-sending device unit 100 is provided with an air-sending device 41 configured to take air into the indoor unit 1 and then release air from the indoor unit 1 and the heat exchanger unit 200 is provided with an indoor heat exchanger 21 configured to serve as an evaporator and condenser. Note that although FIGS. 1 to 3 illustrate conditions in which the heat exchanger unit 200 and air-sending device unit 100 of the indoor unit 1 are coupled together, the heat exchanger unit 200 and air-sending device unit 100 are designed to be separable from each other. The indoor unit 1 is installed, for example, above a ceiling.

The indoor unit 1 includes a panel 11, panel 12, panel 13, and panel 14 making up an outer shell. The panel 11 and panel 12 are provided on a heat exchanger unit housing 200A. The panel 13 and panel 14 are provided on an air-sending device unit housing 100A. Note that when the panel 13 is removed, the air-sending device unit housing 100A is opened, allowing the air-sending device 41 to be carried in and out. Also, when the panel 14 is removed, a filter 120 (see FIG. 15) can be attached to the air-sending device unit housing 100A.

The indoor unit 1 includes a panel 16 and panel 17 making up an outer shell. The panel 16 and panel 17 are provided across both the air-sending device unit housing 100A and heat exchanger unit housing 200A. An inside surface of the panel 16 and inside surface of the panel 17 correspond to a second side face SU2 and third side face SU3 described later.

(Air-Sending Device Unit 100)

The air-sending device unit 100 includes the air-sending device unit housing 100A serving as an outer shell of the air-sending device unit 100, and the air-sending device 41 provided in the air-sending device unit housing 100A, and is designed to take air into the air-sending device unit housing 100A and then supply the air to the heat exchanger unit 200. The air-sending device unit 100 is configured to be detachable from the air-sending device unit 100.

The air-sending device unit housing 100A is a box-shaped member in which the air-sending device 41 is housed and an air inlet 61 is formed. An opening port 60 communicated with the heat exchanger unit housing 200A of the heat exchanger unit 200 described later is formed in the air-sending device unit housing 100A. The air-sending device unit housing 100A is coupled to the heat exchanger unit housing 200A on a formation surface of the opening port 60. A configuration and the like of the air-sending device unit 100 are described in more detail in FIGS. 4 to 7.

(Heat Exchanger Unit 200)

The heat exchanger unit 200 is coupled with the air-sending device unit 100 such that air is supplied from the air-sending device unit 100. The heat exchanger unit 200 has the heat exchanger unit housing 200A, which, being shaped substantially as a rectangular parallelepiped, serves as an outer shell and whose two opposing faces are open.

Also, the heat exchanger unit 200 is equipped with the indoor heat exchanger 21 configured to exchange heat between air supplied from the air-sending device unit 100 and refrigerant supplied from a non-illustrated outdoor unit. The heat exchanger unit 200 is also equipped with a drain pan 31 configured to accumulate condensed water (drain water) produced by the indoor heat exchanger 21.

The heat exchanger unit housing 200A includes a first opening port (not illustrated) located on the side of the opening port 60 of the air-sending device unit housing 100A and an air outlet 62, which is a second opening port formed on a side opposite the first opening port.

The indoor heat exchanger 21 is designed to exchange heat between air taken into the heat exchanger unit housing 200A and the refrigerant supplied from the non-illustrated outdoor unit. It is advisable that the indoor heat exchanger 21 is, for example, a finned-tube heat exchanger made up of plural fins erected upright in parallel and a tube connected to the fins and supplied with refrigerant. The drain pan 31 is placed below the indoor heat exchanger 21.

The indoor heat exchanger 21 is made up, for example, of a first heat exchanger 21*a* and a second heat exchanger 21*b*. The first heat exchanger 21*a* and second heat exchanger 21*b* are placed close to each other at one end, and parted from each other at an other end. That is, one end of the first heat exchanger 21*a* and one end of second heat exchanger 21*b* are placed by being brought close to a center of the heat exchanger unit housing 200A in a width direction. Also, the other end of the first heat exchanger 21*a* is placed close to an inside surface of the heat exchanger unit housing 200A and the other end of the second heat exchanger 21*b* is placed close to an inside surface on an opposite side. Therefore, the indoor heat exchanger 21 is shaped in cross section like a letter A.

The drain pan 31 is designed to accumulate drain water dropping from the indoor heat exchanger 21 and constructed, for example, by forming resin into a predetermined shape. The present embodiment is a manner in which the indoor unit 1 is installed in such a manner as to blow out upward. Consequently, the drain pan 31 is placed on that side face of the heat exchanger unit housing 200A that is coupled to the air-sending device unit housing 100A. Note that the drain pan 31 is placed in such a manner as not to block the first opening port (not illustrated) of the heat exchanger unit housing 200A communicated with the opening port 60 to allow air to flow from the air-sending device unit housing 100A into the heat exchanger unit housing 200A.

The heat exchanger unit 200 is provided with an electrical component box 80. The electrical component box 80 is exposed when the panel 11 is opened. The electrical component box 80 is provided with a controller 81 configured to control rotation speed of the air-sending device 41 and the like. The controller 81 is electrically connected to an electric motor 41B of the air-sending device 41.

[Attachment/Detachment Structure of Air-Sending Device 41]

Figure 4:
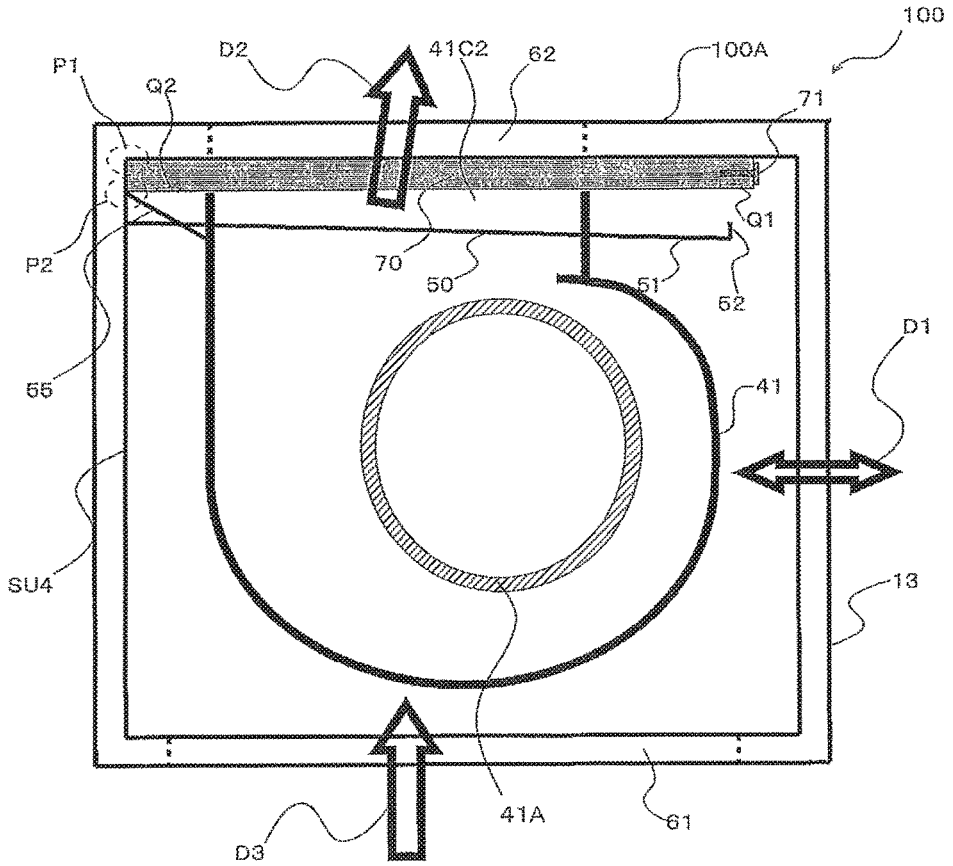
FIG. 4 is a diagram schematically illustrating the air-sending device unit 100 shown in FIG. 3.
Figure 5:
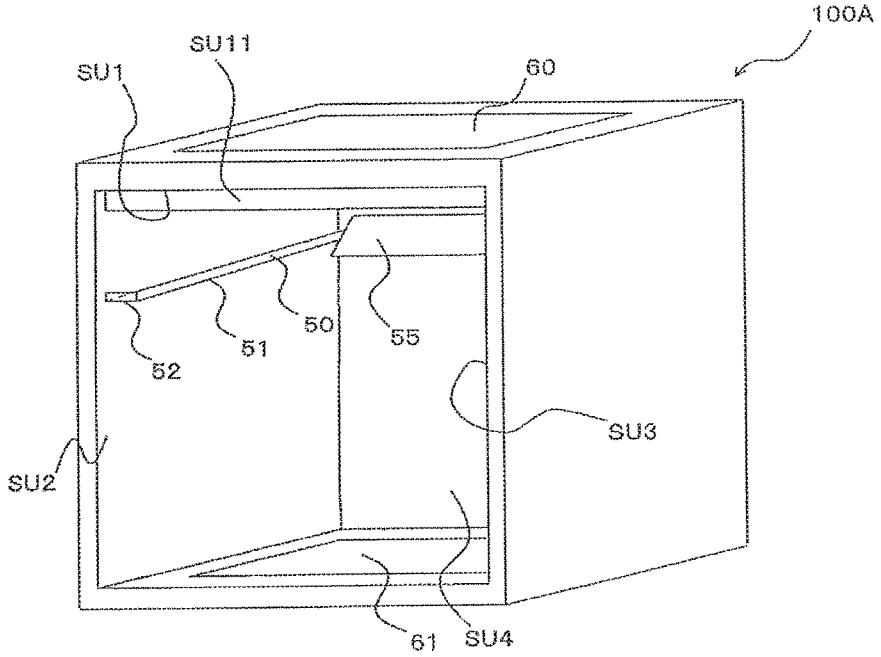
FIG. 5 is a perspective view of an air-sending device unit housing 100A of the air-sending device unit 100 shown in FIG. 4.
Figure 6:
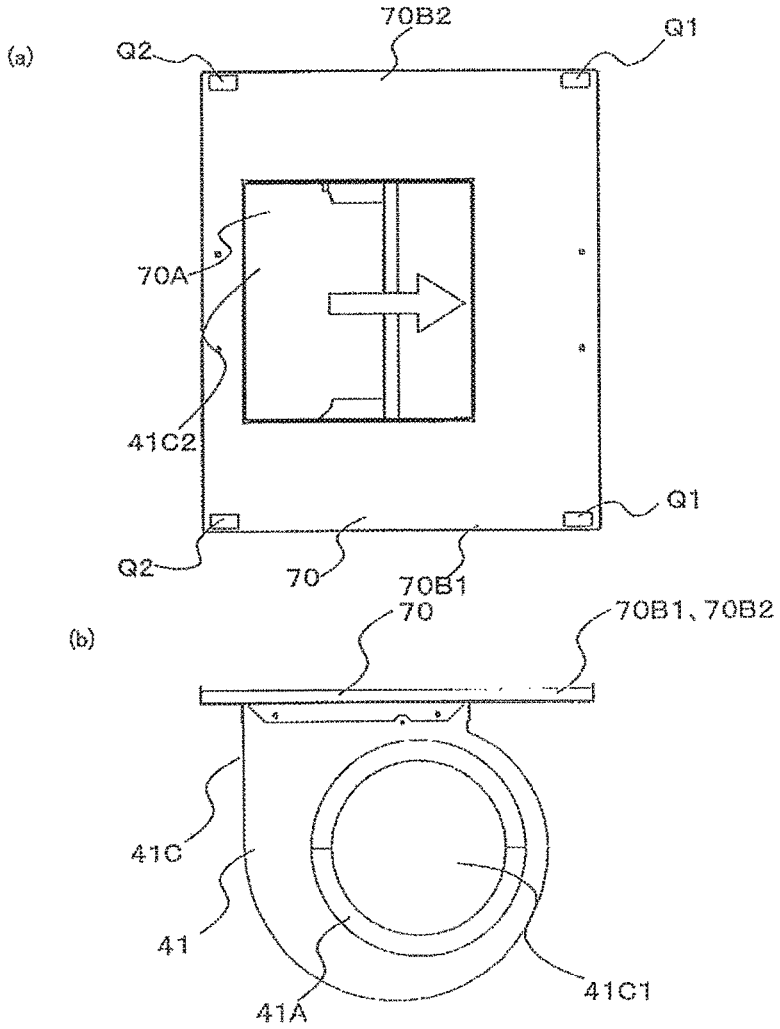
FIGS. 6(*a*) and 6(*b*) are explanatory diagrams of an air-sending device 41 mounted on the air-sending device unit 100 and a slide member 70 fixed to the air-sending device 41.

FIG. 4 is a diagram schematically illustrating the air-sending device unit 100 shown in FIG. 3. FIG. 5 is a perspective view of the air-sending device unit housing 100A of the air-sending device unit 100 shown in FIG. 4. Note that the panel 13 has been removed in FIG. 5, and an internal structure of the air-sending device unit housing 100A is visible. FIGS. 6(*a*) and 6(*b*) are explanatory diagrams of the air-sending device 41 mounted on the air-sending device unit 100 and a slide member 70 fixed to the air-sending device 41, where FIG. 6(*a*) is a diagram of the air-sending device 41 and slide member 70 as viewed from a front side of the slide member 70 and FIG. 6(*b*) is a diagram of the air-sending device 41 and slide member 70 as viewed from a lateral side of the slide member 70. The air-sending device 41, air-sending device unit housing 100A, slide member 70, and the like will be described with reference to FIGS. 4 to 6.

Note that arrow D1 shown in FIG. 4 indicates a sliding direction (attachment/detachment direction) of the slide member 70 and the air-sending device 41 to which the slide member 70 is fixed. Thus, a near side refers to the side of the panel 13 while a back side refers to the side of a fourth side face SU4 described later. Also, arrow D2 shown in FIG. 4 indicates a flow of air blowing out of the air-sending device 41. Furthermore, arrow D3 shown in FIG. 4 indicates a flow of air taken into the air-sending device unit housing 100A through the air inlet 61.

(Air-Sending Device 41)

The air-sending device 41 is made up of a sirocco fan. The sir-sending device 41 includes a rotating fan 41A and an electric motor 41B configured to drive the fan 41A. Also, the air-sending device 41 includes a casing 41C provided with an air inflow port 41C1 and an air outflow port 41C2 and equipped with the fan 41A and the electric motor 41B, where the air inflow port 41C1 takes in air and the air outflow port 41C2 blows out air. Note that the electric motor 41B is connected to the controller 81 and the like provided in the electrical component box 80. In the air-sending device 41, when the fan 41A is rotated by the electric motor 41B, air is taken into the casing 41C through the air inflow port 41C1 and air in the casing 41C is released through the air outflow port 41C2.

As indicated by arrow D2 in FIG. 4, the casing 41C causes the air blowing out of the air outflow port 41C2 to veer to one side rather than blowing out straightly. This is because the air-sending device 41 is made up of a sirocco fan.

(Air-Sending Device Unit Housing 100A)

In the air-sending device unit housing 100A, an opening port 60 communicated with the heat exchanger unit housing 200A is formed at a position of coupling to the heat exchanger unit housing 200A. Besides, in the air-sending device unit housing 100A, a first rail unit 50 is provided on a second side face SU2 orthogonal to a first side face SU1 in which the opening port 60 is formed and a first rail unit 50 is also provided on a third side face SU3 opposed to the second side face SU2. Also, the air-sending device unit housing 100A includes a slide member 70 fixed to the air outflow port 41C2 of the casing 41C of the air-sending device 41 and configured to be movable on the first rail units 50.

Each of the first rail unit 50 includes a rail nit main body 51 installed at an angle such that an opposing distance from the first side face SU1 decreases toward the back side and a claw portion 52 formed at an end of the rail unit main body 51. Here, one of the side faces of the air-sending device unit housing 100A that locates at a position opposite the panel 13 is referred to as the fourth side face SU4. That is, the fourth side face SU4 is orthogonal to the first side face SU1, second side face SU2, and third side face SU3 and is located on the back side in the attachment/detachment direction of the air-sending device 41.

The rail unit main body 51 is installed, extending from the side of the inside surface of the panel 13 to the side of the fourth side face SU4. Since the rail unit main body 51 is provided, when attaching and detaching the air-sending device 41 to and from the air-sending device unit housing 100A, a serviceman can load the slide member 70 fixed to the air-sending device 41 on the rail unit main body 51, slidably move the slide member 70, and thereby slidably move the air-sending device 41. Consequently, the indoor unit 1 can reduce a workload on the serviceman in attaching and detaching the air-sending device 41 to and from the air-sending device unit housing 100A.

The air-sending device unit housing 100A includes a second rail unit 55 provided on the fourth side face SU4. The second rail unit 55 is configured to be separate from the first rail units 50 described above. Also, the second rail unit 55 is installed, extending from the side of the first rail unit 50 provided on the second side face SU2 to the side of the second rail unit 55 provided on the third side face SU3.

The second rail unit 55 is placed in such a manner as to intersect the first rail units 50 when the first rail units 50 and second rail unit 55 are viewed from a direction perpendicular to the second side face SU2 and third side face SU3. Therefore, the second rail unit 55 is placed spanning between the first rail units 50 while extending above and below the first rail units 50. That is, as shown in FIGS. 4 and 5, between the opposite edges of the rail unit main bodies 51, the second rail unit 55 includes a portion located below the rail unit main bodies 51 and a portion located above the rail unit main bodies 51. Accordingly, by being placed in such a manner as to intersect the first rail units 50, the second rail unit 55 allows the slide member 70 to move smoothly from the first rail units 50 to the second rail unit 55 and from the second rail unit 55 to the first rail units 50.

Assuming that a manner in which the second rail unit 55 has only a portion located above the rail unit main bodies 51 with reference to the rail unit main bodies 51. In this manner, a height difference may occur between the first rail units 50 and second rail unit 55. Therefore, the slide member 70 may not move smoothly from the first rail units 50 to the second rail unit 55 or from the second rail unit 55 to the first rail units 50.

Also, the second rail unit 55 is inclined more steeply than the rail unit main bodies 51 of the first rail units 50. That is, in a mounting direction of the air-sending device 41 the second rail unit 55 is installed at an angle such that the opposing distance from the first side face SU1 decreases toward the back side. Accordingly, the air-sending device unit housing 100A, which has the first rail units 50 and second rail unit 55, is structured such that the slide member 70 and air-sending device 41 will move in two stages. Detailed description of how the slide member 70 moves will be given in FIG. 8.

The air-sending device unit housing 100A is configured such that with the slide member 70 being mounted in the air-sending device unit housing 100A, the slide member 70 will be fitted between a back side portion of the second rail unit 55 and the first side face SU1 by being sandwiched therebetween. That is, in terms of thickness of the slide member 70, the slide member 70 is nearly equal to the opposing distance between the back side portion of the second rail unit 55 and the first side face SU1.

(1) Specifically, as shown in FIG. 4, lower part of a back side portion of the slide member 70 is placed in contact with the back side portion (upper end) of the second rail unit 55 (see point P1 in FIG. 4) while upper part of the back side portion of the slide member 70 is placed in contact with the first side face SU1. Accordingly, the back side of the slide member 70 is sandwiched between the back side portion of the second rail unit 55 and the first side face SU1.

(2) Also, as shown in FIGS. 4 and 5, an end face of the slide member 70 on the back side is placed in contact with the fourth side face SU4.

(3) Furthermore, as shown in FIG. 4, the near-side portion of the slide member is fastened, for example, by a fixing member 71 such as a screw or bolt to the first side face SU1 or the like. The slide member 70 is fixed in the air-sending device unit housing 100A through processes described in (1) to (3).

(Slide Member 70)

The slide member 70 is designed to be fixed to the air-sending device 41 and is a flat-plate member in which an opening port 70A is formed to pass air supplied from the air-sending device 41. One end 70B1 of the slide member 70 slides over one of the first rail units 50 and an other end 70B2 slides over the other of the first rail units 50. One face of the slide member 70 is placed opposing the first side face SU1 and an other face is fixed to the air-sending device 41. Fall prevention holes Q1 for the air-sending device 41 are opened in near-side corners of the slide member 70 and fall prevention holes Q2 for the air-sending device 41 are opened in back side corners (see FIG. 6(*a*)). Also, ends 70B1 and 70B2 of the slide member 70 are cut and raised by bending. Similarly, a front-side end and rear-side end of the slide member 70 are also cut and raised by bending. The raised front-side end of the slide member 70 is fastened to a fixing portion SU11 formed on the first side face SU1 with a fixing member 71 inserted (see FIG. 7 and FIG. 8(*e*) described later).

[About Claw Portion 52]

Figure 7:
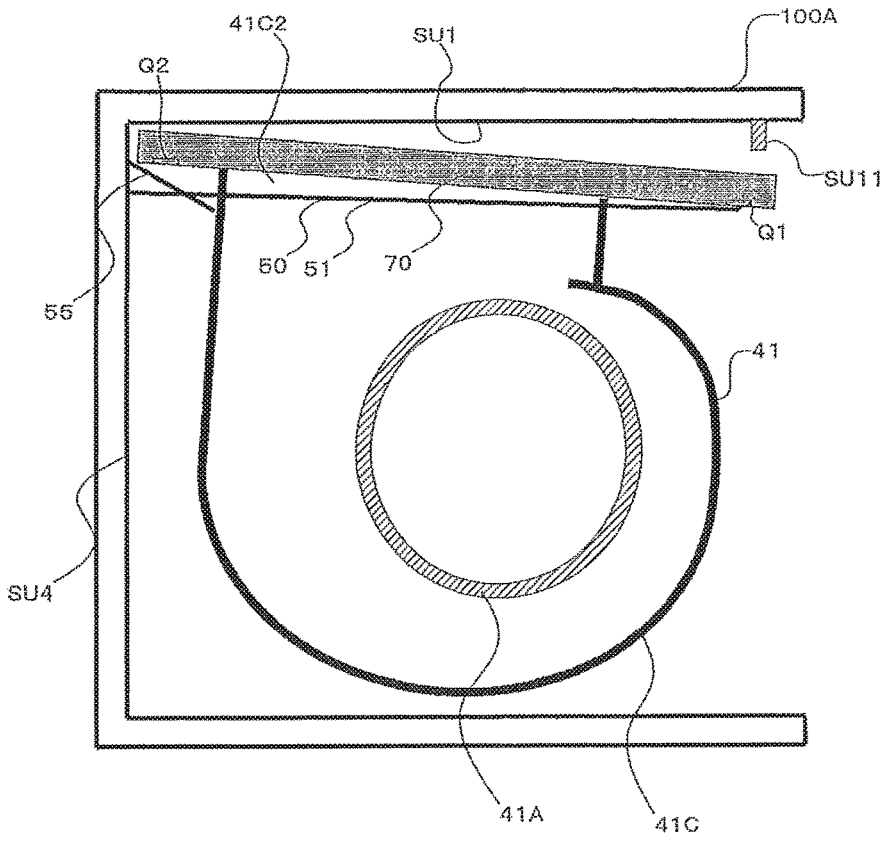
FIG. 7 is an explanatory diagram of a claw portion 52 formed on each of first rail units 50 of the indoor unit 1 of the air-conditioning apparatus according to the embodiment of the present invention.

FIG. 7 is an explanatory diagram of a claw portion 52 formed on each of the first rail units 50 of the indoor unit 1 of the air-conditioning apparatus according to the present embodiment. Note that the panel 13 has been removed in FIG. 7.

The claw portion 52 is formed at a near-side end of the rail unit main body 51. The claw portions 52 prevent the slide member 70 as well as the air-sending device 41 to which the slide member 70 is fixed from falling when the serviceman is attaching or detaching the air-sending device 41 to/from the air-sending device unit 100.

When the fixing member 71 is removed, the claw portions 52 not illustrated in FIG. 7 engage with prevention holes Q1. This can prevent the air-sending device 41 from falling down by sliding the slide member 70 off the first rail units 50. Note that the fall prevention holes Q2 can also prevent the air-sending device 41 from falling down accidentally just before the slide member 70 leaves the first rail units 50 when the slide member 70 is being drawn out of the first rail units 50.

[About Operation of the Slide Member 70]

Figure 8:
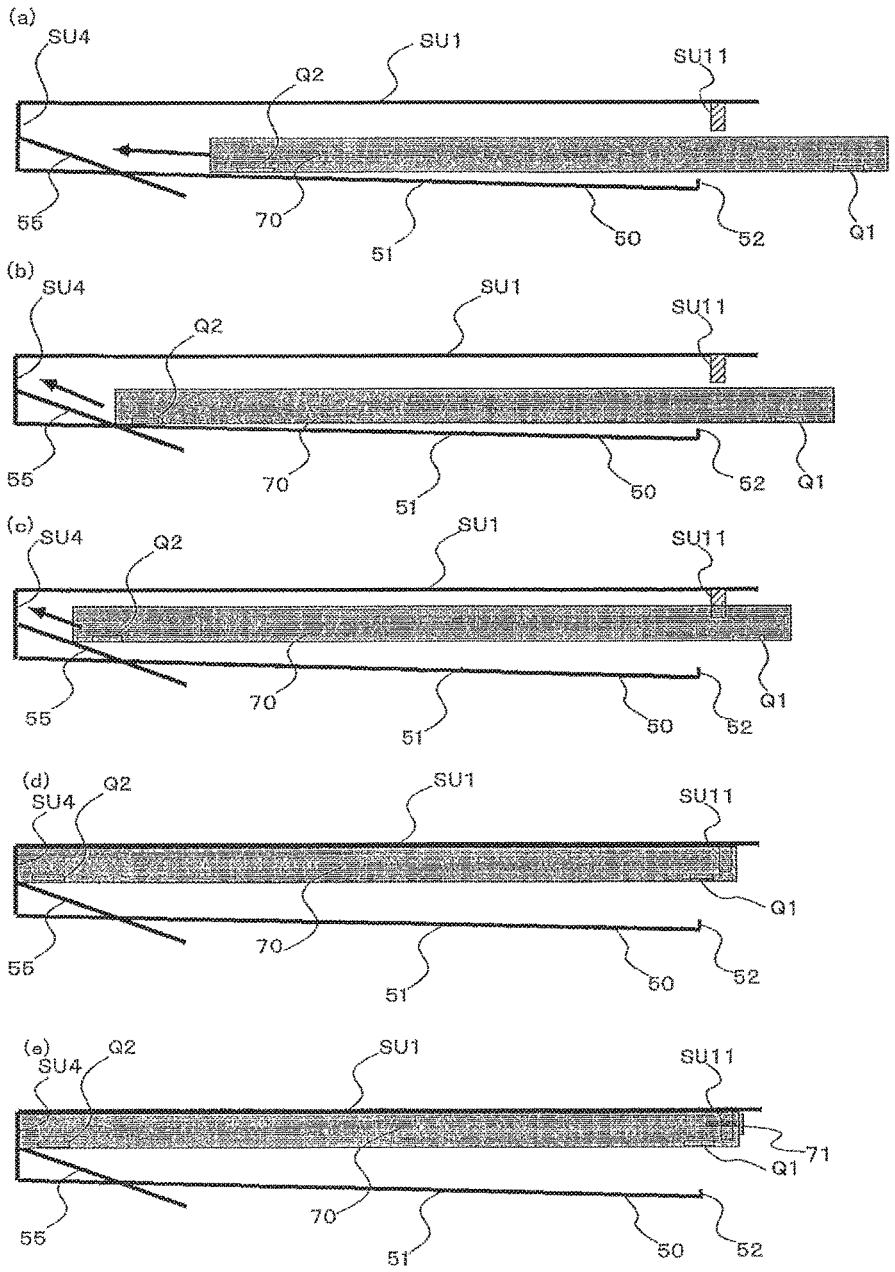
FIGS. 8(*a*) to 8(*e*) are operation explanation diagrams of the slide member 70.

FIGS. 8(*a*) to 8(*e*) are operation explanation diagrams of the slide member 70. FIG. 8(*a*) shows how the slide member 70 is slid over the rail unit main bodies 51 of the first rail units 50. FIG. 8(*b*) shows how the slide member 70 abuts the second rail unit 55 after being moved to the back side of the rail unit main body 51. FIG. 8(*c*) shows how the slide member 70 is being moved to the back side of the second rail unit 55. FIG. 8(*d*) shows how the slide member 70 is fitted among the first side face SU1, fourth side face SU4, and second rail unit 55 by being moved to the rear end of the second rail unit 55. FIG. 8(*e*) shows how the near-side portion of the slide member 70 is fastened to the fixing portion SU11 of the first side face SU1 with the fixing member 71. Note that the air-sending device 41 is not illustrated in FIGS. 8(*a*) to 8(*e*) for convenience of explanation.

When mounting the air-sending device 41 in the air-sending device unit housing 100A, the serviceman will move the slide member 70 in the order: FIG. 8(*a*) to FIG. 8(*e*). When removing the air-sending device 41 from the air-sending device unit housing 100A, the order is reversed. Accordingly, since the air-sending device unit 100 is provided with the first rail units 50 and second rail unit 55 each having different inclinations and structured such that the slide member 70 and air-sending device 41 move in two stages, it is possible to reduce a load on the serviceman in attaching and detaching the air-sending device 41 to and from the air-sending device unit housing 100A.

A form in which the second rail unit 55 is not provided is also possible, but the effect of reducing the workload on the serviceman is greater when the second rail unit 55 is provided. If a form in which the second rail unit 55 is not provided is used, means of increasing an inclination of the whole first rail units 50 can be adopted.

Here, the workload on the serviceman is greater when the slide member 70 is located on the near side of the first rail units 50. This is because when the slide member 70 has been inserted until reaching the back side of the first rail unit, most part of the air-sending device 41 has been carried into the air-sending device unit housing 100A and an attitude of the air-sending device 41 is stable.

Therefore, when the inclination of the whole first rail units 50 is increased, the inclination of the first rail units 50 on the near side is increased as well, consequently increasing a burden on the serviceman as well.

As the second rail unit 55 with a large inclination is installed on the back side of the first rail units 50, the air-sending device unit housing 100A of the indoor unit 1 according to the present embodiment curbs increases in the burden on the serviceman.

[About Positional Relationship Between Indoor Heat Exchanger 21 and Air-Sending Device 41]

Figure 9:
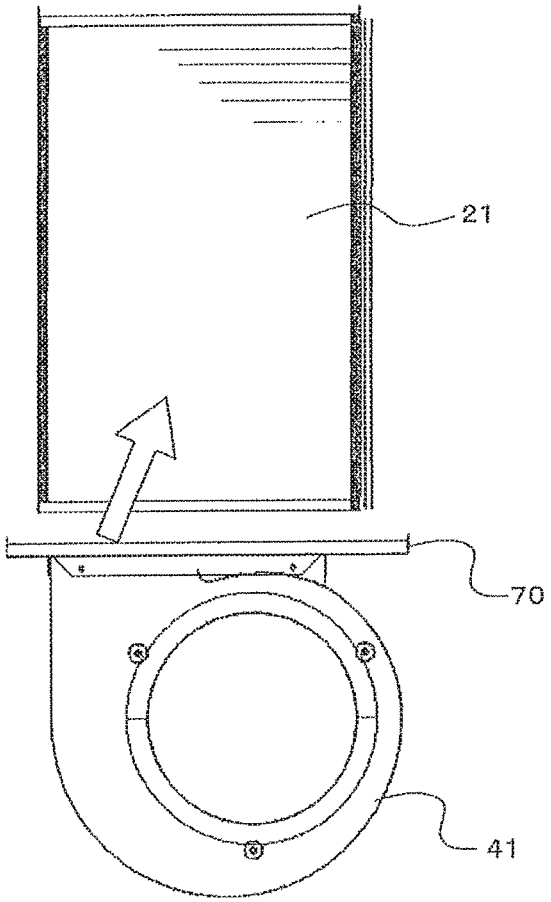
FIG. 9 is an explanatory diagram of positional relationship between an indoor heat exchanger 21 and the air-sending device 41 mounted on the indoor unit 1 of the air-conditioning apparatus according to the embodiment of the present invention.
Figure 10:
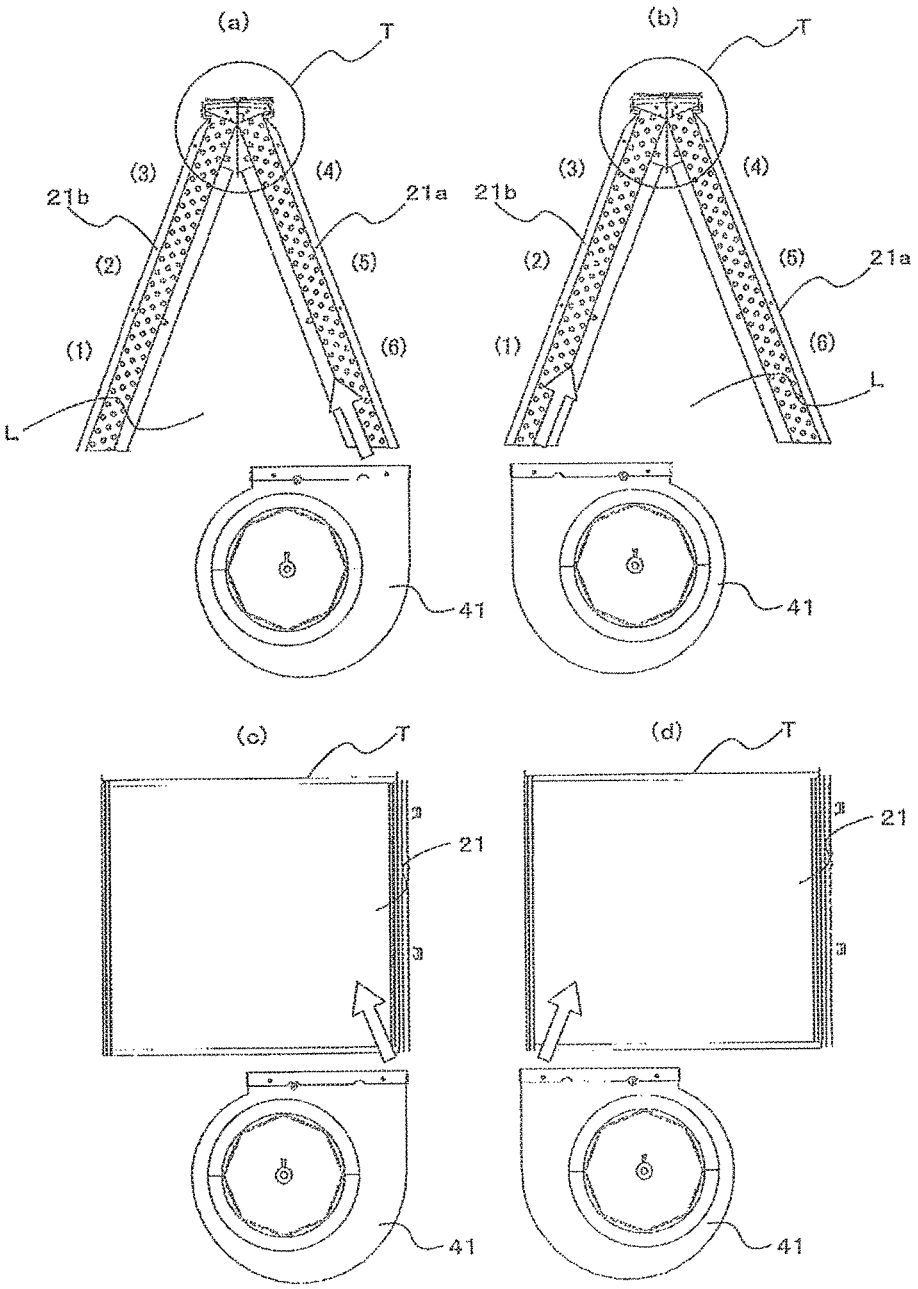
FIGS. 10(*a*) to 10(*d*) are explanatory diagrams of four patterns of the positional relationship between the indoor heat exchanger 21 and air-sending device 41.

FIG. 9 is an explanatory diagram of positional relationship between the indoor heat exchanger 21 and air-sending device 41 mounted on the indoor unit 1 of the air-conditioning apparatus according to the present embodiment. Note that FIG. 9 corresponds to FIG. 10(*d*). FIGS. 10(*a*) to 10(*d*) are explanatory diagrams of four patterns of the positional relationship between the indoor heat exchanger 21 and air-sending device 41. FIGS. 10(*a*) and 10(*b*) show positional relationships under conditions of poor heat exchange efficiency while FIGS. 10(*c*) and 10(*d*) show positional relationships under conditions of good heat exchange efficiency.

In FIGS. 10(*a*) to 10(*d*), a contact portion T between the first heat exchanger 21*a* and second heat exchanger 21*b* is placed on a side opposite the air-sending device 41.

The heat exchange efficiency varies with the positional relationship between the indoor heat exchanger 21 and air-sending device 41. As shown in FIG. 10(*a*), the heat exchange efficiency is reduced when the indoor heat exchanger 21 and air-sending device 41 are placed such that an airflow direction of the air-sending device 41 is oriented along the first heat exchanger 21*a*. Most of the air blown out of the air-sending device 41 passes through the first heat exchanger 21*a*, but only a little of the air passes through the second heat exchanger 21*b*, and thus the heat exchange efficiency of the indoor heat exchanger 21 as a whole is reduced.

FIG. 10(*b*) is a manner in which the air-sending device 41 is placed bilaterally symmetrically to the air-sending device 41 in FIG. 10(*a*). In this manner, most of the air blown out of the air-sending device 41 passes through the second heat exchanger 21*b*, but only a little of the air passes through the second heat exchanger 21*b*, and thus the heat exchange efficiency of the indoor heat exchanger 21 as a whole is reduced.

In the manners shown in FIGS. 10(*c*) and 10(*d*), the indoor heat exchanger 21 in FIGS. 10(*a*) and 10(*b*) has been turned 90 degrees. In FIGS. 10(*c*) and 10(*d*), the air blown out of the air-sending device 41 flows into a space L (see FIGS. 10(*a*) and 10(*b*)) between the first heat exchanger 21*a* and second heat exchanger 21*b*, and thus air flows uniformly into both the first heat exchanger 21*a* and second heat exchanger 21*b*, making it possible to curb reductions in the heat exchange efficiency.

Note that although not illustrated, if the contact portion T is set to be located on the side of the air-sending device 41 in FIGS. 10(*c*) and 10(*d*), air also flows uniformly into both the first heat exchanger 21*a* and second heat exchanger 21*b*, making it possible to curb reductions in the heat exchange efficiency.

[Advantageous Effects of Indoor Unit 1 According to Present Embodiment]

The indoor unit 1 of the air-conditioning apparatus according to the embodiment includes the first rail units 50 and slide member 70. Consequently, the serviceman can attach and detach the air-sending device 41 by sliding the slide member 70 over the first rail units 50. This makes it possible to curb increases in the workload of changing the direction of the indoor unit when changing the airflow direction.

Note that although a manner in which the first rail units 50 and second rail unit 55 are configured to be separate bodies has been described, the present embodiment is not limited thereto. For example, a wedge-shaped member having an inclination corresponding to that of the second rail unit 55 may be formed at a back side end of the rail unit main body 51. This manner also offers effects similar to those of the present embodiment.

Although a manner in which the rail unit main body 51 is linear has been described as an example, the present embodiment is not limited thereto and the rail unit main body 51 may be formed into a wavelike shape or bent shape. This manner also offers effects similar to those of the present embodiment.

Although a manner in which the second rail unit 55 is shaped like a flat plate has been described as an example, the present embodiment is not limited thereto and the second rail unit 55 may be formed into a wavelike shape or bent shape. Also, although a manner in which the second rail unit 55 is installed, extending continuously from the side of the inside surface of the panel 13 to the side of the fourth side face SU4 has been described, the present embodiment is not limited thereto and the second rail unit 55 may be intermittent with notches formed therein. This form also offers effects similar to those of the present embodiment.

[Modification 1]

Figure 11:
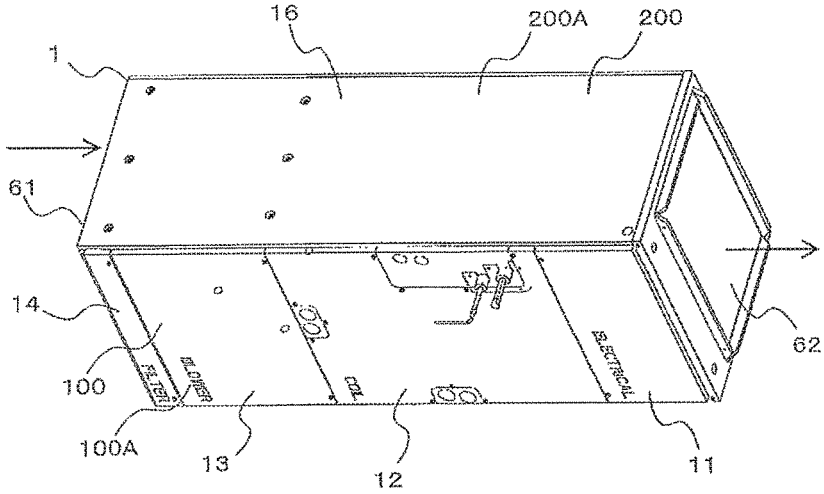
FIG. 11 is a perspective view of an indoor unit 1 of an air-conditioning apparatus according to Embodiment 2 of the present invention.
Figure 12:
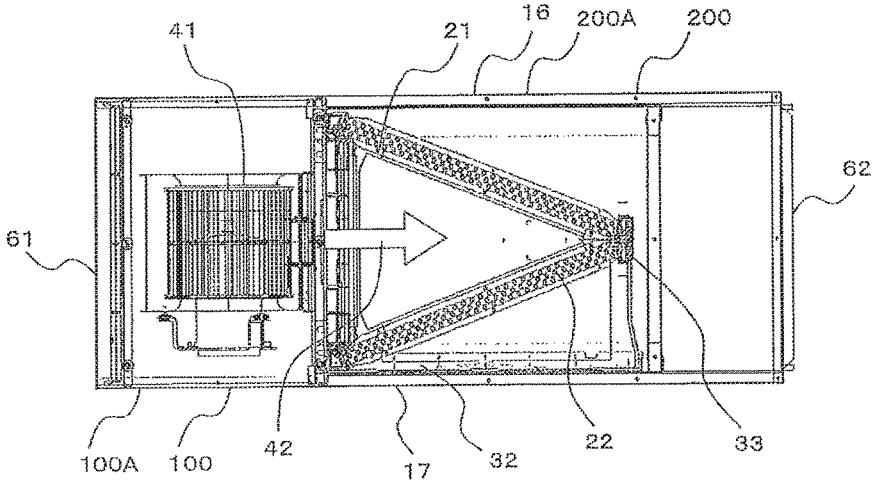
FIG. 12 is a longitudinal sectional view of the indoor unit 1 shown in FIG. 11.

FIG. 11 is a perspective view of an indoor unit 1 of an air-conditioning apparatus according to Modification 1 of the present invention. FIG. 12 is a longitudinal sectional view of the indoor unit 1 shown in FIG. 11. Whereas a manner in which the indoor unit 1 blows out upward has been described in the embodiment, the present modification shows a case in which the indoor unit 1 is installed in such a manner as to blow out sideways (from left to right in the drawing). In the present modification, a drain pan 32 is placed below the indoor heat exchanger 21. Specifically, the drain pan 32 is placed on the panel 17. The indoor unit 1 of the air-conditioning apparatus according to the present modification achieves effects similar to those of the indoor unit 1 of the air-conditioning apparatus according to the embodiment.

[Modification 2]

Figure 13:
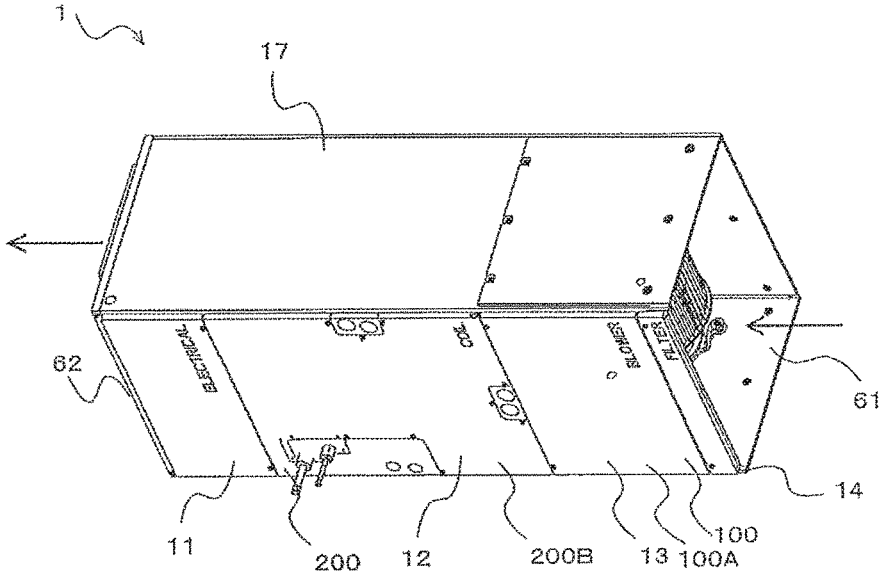
FIG. 13 is a perspective view of an indoor unit 1 of an air-conditioning apparatus according to Embodiment 3 of the present invention.
Figure 14:
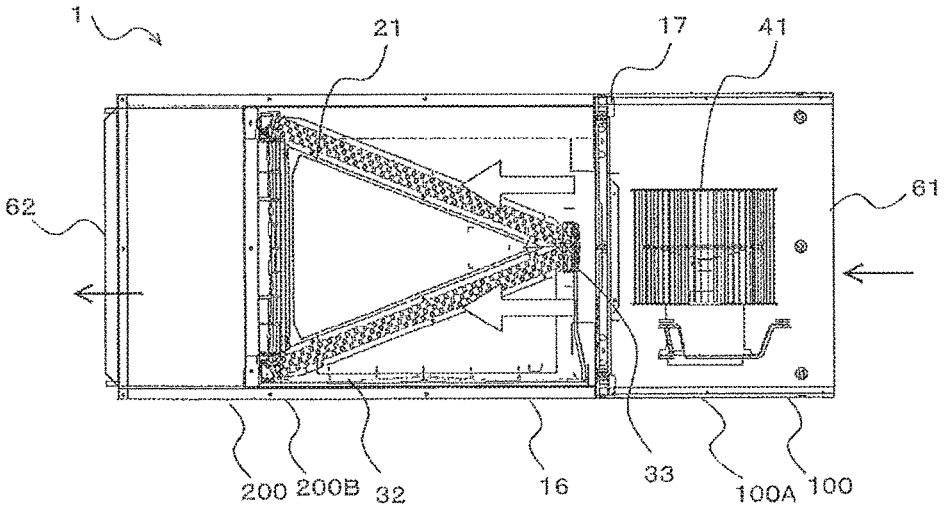
FIG. 14 is a longitudinal sectional view of the indoor unit 1 shown in FIG. 13.

FIG. 13 is a perspective view of an indoor unit 1 of an air-conditioning apparatus according to Modification 2. FIG. 14 is a longitudinal sectional view of the indoor unit 1 shown in FIG. 13. The present modification shows a case in which the indoor unit 1 is installed in such a manner as to blow out sideways (from right to left in the drawing). Also, in the indoor unit 1 of the air-conditioning apparatus according to the present modification, the indoor heat exchanger 21 is placed such that the contact portion T between the first heat exchanger 21*a* and second heat exchanger 21*b* is to be on the side of the air outlet 62 (on the side opposite the air-sending device 41). In the present modification, the drain pan 32 is placed below the indoor heat exchanger 21. Specifically, the drain pan 32 is placed on the panel 16. Furthermore, in the present modification, an installation direction of the air-sending device 41 has been turned 180 degrees from that of Modification 1. That is, the present modification differs from Modification 1 in that an installation direction of the indoor heat exchanger 21 is turned 180 degrees, that the drain pan 32 is placed on the panel 16 rather than the panel 17, and that the installation direction of the air-sending device 41 is turned 180 degrees. The indoor unit 1 of the air-conditioning apparatus according to the present modification achieves effects similar to those of the indoor unit 1 of the air-conditioning apparatus according to Embodiment 2.

[Modification 3]

Figure 15:
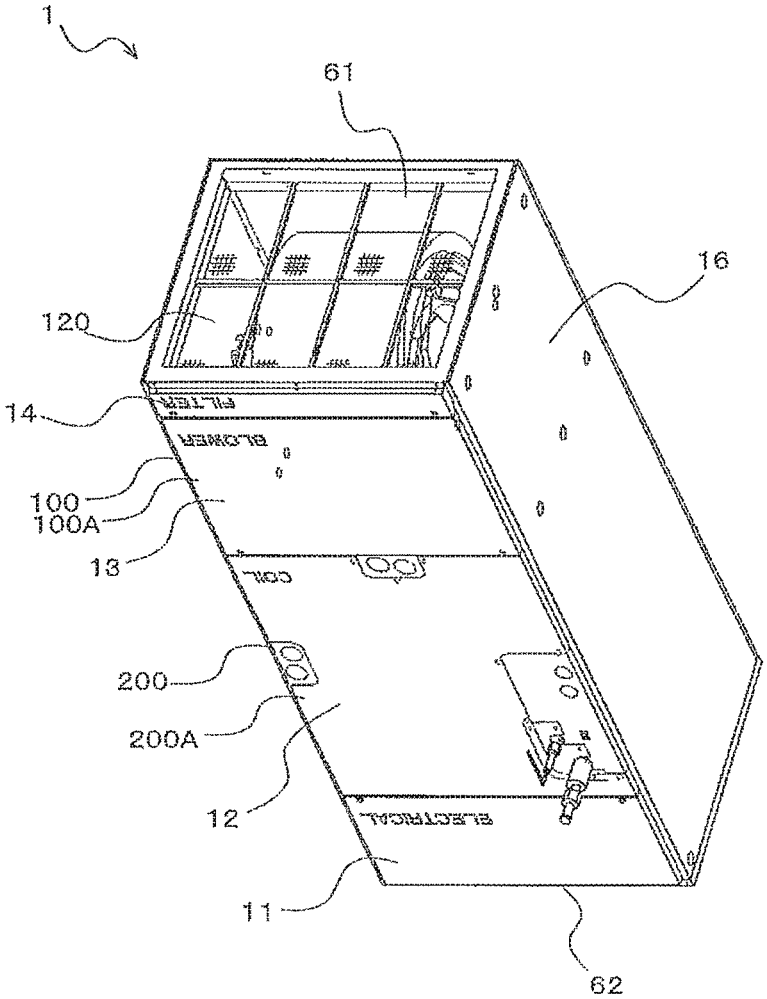
FIG. 15 is a perspective view of an indoor unit 1 of an air-conditioning apparatus according to Embodiment 4 of the present invention.
Figure 16:
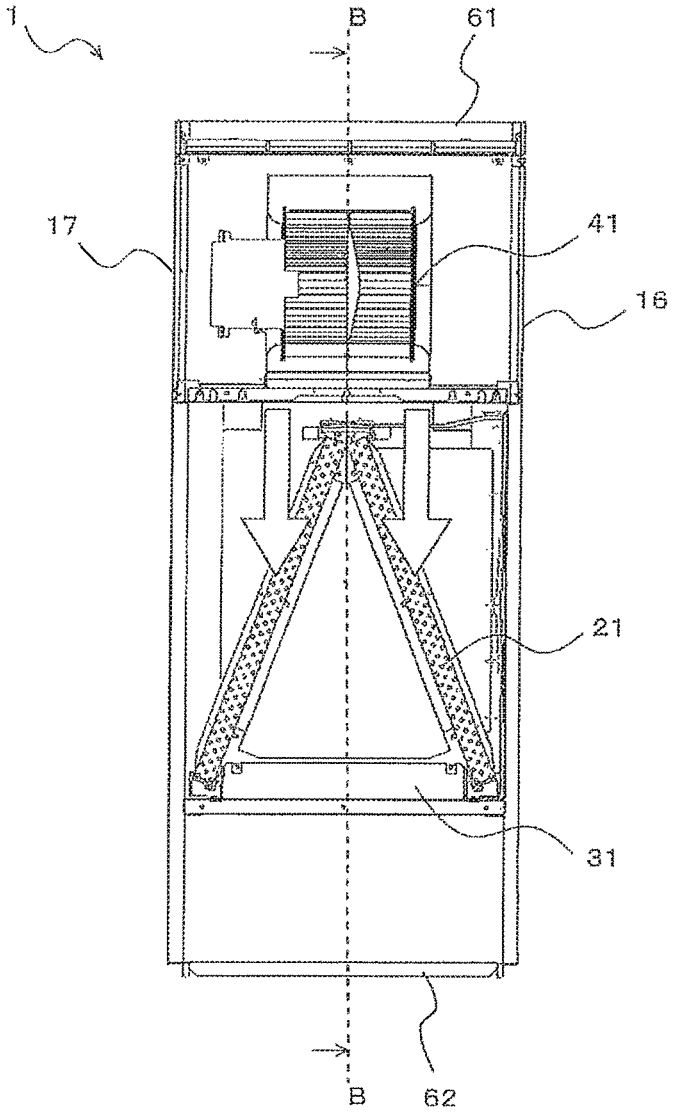
FIG. 16 is a longitudinal sectional view of the indoor unit 1 shown in FIG. 15.
Figure 17:
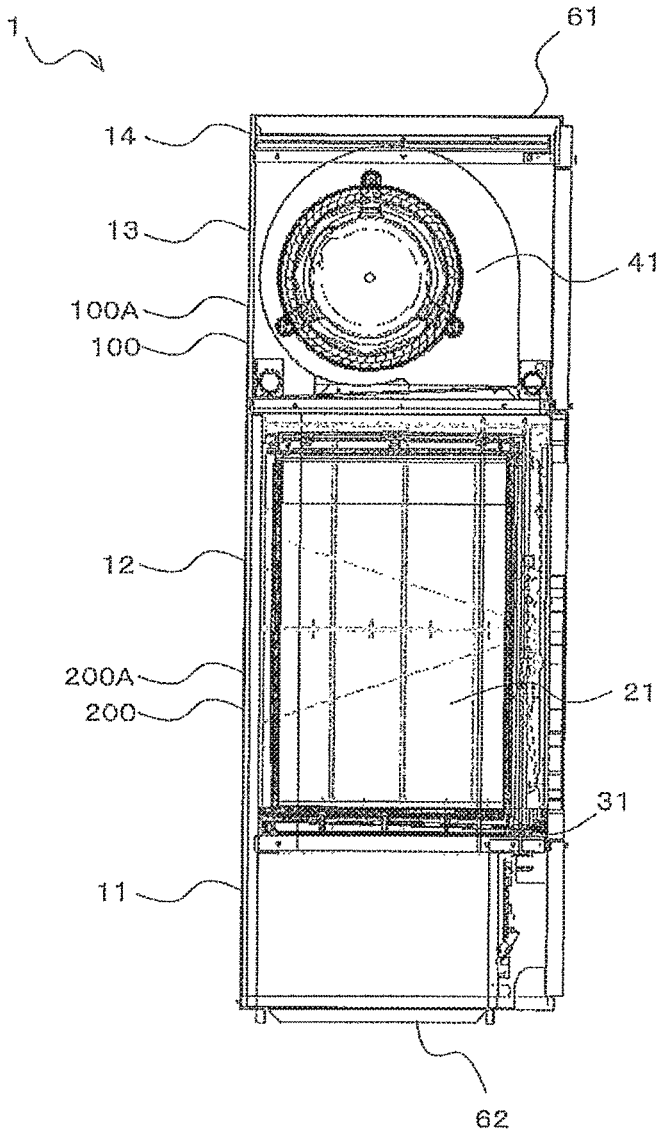
FIG. 17 is a sectional view of the indoor unit 1 shown in FIG. 16 taken along line B-B.

FIG. 15 is a perspective view of an indoor unit 1 of an air-conditioning apparatus according to Modification 3. FIG. 16 is a longitudinal sectional view of the indoor unit 1 shown in FIG. 15. FIG. 17 is a sectional view of the indoor unit 1 shown in FIG. 16 taken along line B-B. The present modification shows a case in which the indoor unit 1 is installed in such a manner as to blow out downward. In the indoor unit 1 of the air-conditioning apparatus according to the present modification, the indoor heat exchanger 21 is placed such that the contact portion T between the first heat exchanger 21*a* and second heat exchanger 21*b* is to be on the side of the air-sending device 41 as with Modification 1.

In the present modification, the drain pan 31 is placed below the indoor heat exchanger 21. The drain pan 31 is placed, for example, on the side of the air outlet 62 in the heat exchanger unit housing 200A.

Furthermore, in the present modification, a filter 120 is attached to the air-sending device unit 100. When the indoor unit 1 blows out downward, dust in the air is prone to enter the indoor unit 1, and thus it is advisable to attach the filter 120. The indoor unit 1 of the air-conditioning apparatus according to the present modification achieves effects similar to those of the indoor unit 1 of the air-conditioning apparatus according to Embodiment 2.

REFERENCE SIGNS LIST

1 indoor unit 11 panel 12 panel 13 panel 14 panel 16 panel 17 panel 21 indoor heat exchanger 21*a* first heat exchanger

21*b* second heat exchanger 31 drain pan 32 drain pan 41A fan 42 air-sending device 41B electric motor 41C casing 41C1 air inflow port 41C2 air outflow port 50 first rail unit 51 rail unit main body 52 claw portion 55 second rail unit 60 opening port 61 air inlet 62 air outlet 70 slide member 70A opening port 70B1 end 70B2 end 71 fixing member 80 electrical component box 81 controller 100 air-sending device unit 100A air-sending device unit housing 120 filter

200 heat exchanger unit 200A heat exchanger unit housing D1 arrow D2 arrow D3 arrow L space SU1 first side face SU11 fixing portion SU2 second side face SU3 third side face SU4 fourth side face T contact portion Q1 fall prevention hole Q2 fall prevention hole

The invention claimed is:

1. An indoor unit of an air-conditioning apparatus comprising: an air-sending device unit having an air-sending device unit housing configured to house an air-sending device, the air-sending device unit housing being provided with an air inlet; and a heat exchanger unit having a heat exchanger unit housing configured to house an indoor heat exchanger, the heat exchanger unit housing being provided with an air outlet and configured to be coupled to the air-sending device unit housing, the air-sending device including a fan configured to rotate, an electric motor configured to drive the fan, and a casing provided with an air inflow port from which air is sucked and an air outflow port from which the air is blown out, the casing being equipped with the fan and the electric motor, the air-sending device unit housing being provided with an opening port formed at a position of coupling to the heat exchanger unit housing and communicating with the heat exchanger unit housing, first rail units each provided on a second side face orthogonal to a first side face in which the opening port is formed and a third side face orthogonal to a first face, a second rail unit provided on a fourth surface located on a back side in an attachment-detachment direction of the air-sending device, the fourth face being orthogonal to the first side face, the second side face, and the third side face, and a slide member fixed to the air outflow port of the casing of the air-sending device and configured to be movable on the first rail units, in the attachment-detachment direction, an opposing distance between the back side of the second rail unit and the first side face is smaller than an opposing distance between a front side of the second rail unit and the first side face.

2. The indoor unit of an air-conditioning apparatus of claim 1, wherein each of the first rail units includes a first face, and in the attachment-detachment direction, an opposing distance between a back side of the first face and the first side face is smaller than an opposing distance between a front side of the first face and the first side face.

3. The indoor unit of an air-conditioning apparatus of claim 2, wherein the second rail unit includes a second face, in the attachment-detachment direction, an opposing distance between a back side of the second face and the first face is smaller than an opposing distance between a front side of the second face and the first side face, and a second angle between the second face and the attachment-detachment direction is greater than a first angle between the first face and the attachment-detachment direction.

4. The indoor unit of an air-conditioning apparatus of claim 1, wherein, the slide member includes a first portion located, in a state in which the slide member is mounted in the air-sending device unit housing, on a back side in the attachment-detachment direction, and a second portion located, in the state in which the slide member is mounted in the air-sending device unit housing, on a front side in the attachment-detachment direction than the first portion, and in a state in which the slide member is mounted in the air-sending device unit housing, in the air-sending device unit housing, the first portion of the slide member is fitted between a back side portion of the second rail unit and the first side face.

5. The indoor unit of an air-conditioning apparatus of claim 4, wherein the second rail unit includes a third portion located on the back side in the attachment-detachment direction of the air-sending device, and a fourth portion located on the front side in the attachment-detachment direction of the air-sending device than the third portion, and the slide member has a thickness approximately a same as an opposing distance between the third portion of the second rail unit and the first side face.

6. The indoor unit of an air-conditioning apparatus of claim 1, wherein when the first rail units and the second rail unit are viewed from a direction perpendicular to the second side face and the third side face, the second rail unit is placed intersecting the first rail units.

7. The indoor unit of an air-conditioning apparatus of claim 1, wherein the second rail unit is installed such that the second rail unit extends from one of the first rail units to another of the first rail units.

8. The indoor unit of an air-conditioning apparatus of claim 1, wherein claw portions configured to prevent the slide member from falling are provided at front-side ends of the first rail units in the attachment-detachment direction.

9. The indoor unit of an air-conditioning apparatus of claim 8, wherein the slide member includes corner portions located at corners, on each of the corner portions, fall prevention holes each being engaged with the claw portions are formed.

10. The indoor unit of an air-conditioning apparatus of claim 9, wherein the slide member includes a first corner portion located on a front-side in the attachment detachment direction, and the fall prevention holes includes a first fall prevention hole, the first prevention hole being formed on the first corner portion and being engaged with one of the claw portions.

11. The indoor unit of an air-conditioning apparatus of claim 9, wherein the slide member includes a second corner portion located on a back side in the attachment detachment direction, and the fall prevention holes includes a second fall prevention hole, the second prevention hole being formed on the second corner portion and being engaged with one of the claw portions.

12. The indoor unit of an air-conditioning apparatus of claim 1, wherein the indoor heat exchanger includes a first heat exchanger and a second heat exchanger, the first heat exchanger includes a first end located at one end of the heat exchanger unit housing in an air flow direction, and a second end located at another end of the heat exchanger unit housing in the air flow direction, the second heat exchanger includes a third end located at the one end in the air flow direction, and a fourth end located at the other end in the air flow direction, and an opposing distance between the second end the fourth end is greater than an opposing direction between the first end and the third end.

13. The indoor unit of an air-conditioning apparatus of claim 1, wherein the slide member includes a first portion located, in a state in which the slide member is mounted in the air-sending device unit housing, on the back side in the attachment-detachment direction, and, a second portion located, in the state in which the slide member is mounted in the air-sending device unit housing, on a front side in the attachment-detachment direction than the first portion, the second rail unit includes a third portion located on the back side in the attachment-detachment direction of the air-sending device, and a fourth portion located on the front side in the attachment-detachment direction of the air-sending device than the third portion, the first portion of the slide member fits, in the state in which the slide member is mounted in the air-sending device unit housing, between the third portion of the second rail unit and the first side face, and the second portion of the slide member is fixed, in the state in which the slide member is mounted in the air-sending device unit housing, to the first side face.

14. The indoor unit of an air-conditioning apparatus of claim 13, wherein the first side face is provided with a fixed portion, the second portion of the slide member is fixed, in the state in which the slide member is mounted in the air-sending device unit housing, to the first side face by fixing a fixing member to the fixing portion, the fixing member being disposed in parallel with a direction from the second portion toward the first portion of the slide member.

* * * * *